United States Patent [19]

Höfer

[11] Patent Number: 4,741,314

[45] Date of Patent: May 3, 1988

[54] FUEL INJECTION PUMP FOR INTERNAL COMBUSTION ENGINE

[75] Inventor: Gerald Höfer, Weissach-Flacht, Fed. Rep. of Germany

[73] Assignee: Robert Bosch GmbH, Stuttgart, Fed. Rep. of Germany

[21] Appl. No.: 881,937

[22] Filed: Jul. 3, 1986

[30] Foreign Application Priority Data

Jul. 6, 1985 [DE] Fed. Rep. of Germany ..... 3524241

[51] Int. Cl.[4] ..... F02M 59/24

[52] U.S. Cl. ..... 123/449; 123/503; 123/506; 417/494

[58] Field of Search ..... 123/449, 500, 503, 506; 417/289, 494, 499

[56] References Cited

U.S. PATENT DOCUMENTS

| | | | |
|---|---|---|---|
| 3,942,914 | 3/1976 | Hofer et al. | 417/289 |
| 4,271,808 | 1/1981 | Kobayashi et al. | 123/506 |
| 4,407,253 | 10/1983 | Bauer | 123/449 |
| 4,635,605 | 1/1987 | Faupel et al. | 123/449 |

FOREIGN PATENT DOCUMENTS

| | | | |
|---|---|---|---|
| 1109955 | 6/1961 | Fed. Rep. of Germany | 123/449 |
| 3018791 | 11/1981 | Fed. Rep. of Germany | 123/449 |

*Primary Examiner*—Tony M. Argenbright
*Assistant Examiner*—Eric R. Carlberg
*Attorney, Agent, or Firm*—Felfe & Lynch

[57] ABSTRACT

A fuel injection pump for internal combustion engines is proposed wherein control over the injected fuel quantity is exercised by regulating the outlet (C) of a second relief line (33) of the working space (5) of the fuel injection pump by means of a control edge (25) positionable as a function of load and/or speed in the part-load range, and optionally of the first outlet cross-sectional area (D), displaced along the stroke, of a first relief line (15). In full-load operation, the effective length of the delivery stroke is limited by opening a relief opening (E) carried by the pumping plunger at a control edge (9). To obtain delivery at reduced fuel injection rate, especially at no load or low load, over as long a stroke length ($h_L$) as possible, fuel-quantity control is effected, first, with respect to the duration of injection, by means of the control edge (25) which controls the outlet (C), and secondly, by opening, at a constant point along the stroke, the relief opening (E). The leakage rate per plunger stroke can be predetermined by means of a throttle (34) located at the outlet (E).

25 Claims, 5 Drawing Sheets

FUEL INJECTION PUMP FOR INTERNAL COMBUSTION ENGINE

BACKGROUND OF THE INVENTION

The invention relates to a fuel injection pump for internal combustion engines. With such a pump, known from published German patent application DOS No. 23 53 737, no sharp break is obtained in the injected fuel quantity vs. speed curve at breakaway from full-load operation as maximum no-load speed is approached. Rather, the curve is more or less blurred, so that a theoretical maximum-load point at maximum speed resulting from the linear extension of the full-load curve, and hence maximum power of the internal combustion engine fueled by the fuel injection pump, is not attained. This blurring of the curve is due to a hunting of the control system at the moment at which the energy output of the speed sensor and the force of the governor spring are balanced. This occurs just before speed regulation sets in. A control lever loaded by a return spring, which previously abutted on a full-load stop, is then lifted off the full-load stop to position the fuel-quantity adjusting element in the direction of zero fuel injection. Because of the hunting of the control system, this occurs prematurely rather than at the theoretical maximum-load point.

SUMMARY OF THE INVENTION

In contrast thereto, the fuel injection pump of the invention offers the advantage that the maximum quantity of fuel injected at full load is determined, not by the control edge guided by the control system as a function of load and/or speed but by the location of the relief opening relative to the relief line, which determines the maximum possible delivery stroke of the pumping plunger. This permits the full-load breakaway applicable to the prior-art fuel injection pump to be shifted in the pump here proposed beyond the point defined by the location of the relief opening as the actual full-load point. As a result, metering is not affected by the instability at breakaway. In the part-load range, however, the fuel quantity continues to be controlled by the load-dependent and/or speed-dependent positioning of the control edge.

This measure further permits the realization of a quiet-idle device whereby a maximum operating range of the fuel injection pump is advantageously provided by the simplest means to obtain a rate of fuel injection that is reduced in relation to the full-load fuel injection rate per angle of rotation of the drive shaft of the fuel injection pump. Yet the duration of injection in full-load operation is not unduly lengthened. A reduced fuel injection rate in the part-load operating range over pumping-plunger strokes of maximum length results in a desirable reduction of the combustion noise, as is known from other approaches.

From published German patent application DOS No. 23 53 737, a fuel injection pump is known wherein a quiet-idle device is realized. A portion of the amount of fuel pumped by the plunger is able to flow off through the second relief channel during the delivery strokes of the pumping plunger. This reduces the injection rate and results in a lengthening of the duration of injection when the quantity of fuel injected per plunger stroke is controlled by the fuel-quantity regulator.

In the prior-art fuel injection pump, the position of the outlet C of the second relief line or its control points must be dimensioned so in relation to the control times of the connection between the inlet A to the second relief line and the outlet B of the relief line which is connected directly with the working space of the pump (first relief line) that with the control edge, positionable as a function of load and/or speed, set for full load, fuel is no longer able to flow off through the second relief line to reduce the fuel-injection rate and the full delivery rate of the pumping plunger is effective. Moreover, since the end of fuel delivery occurs as the outlet D of the first relief line is opened, in the prior-art pump there results in the middle to upper part-load range, after an initial part stroke of the pumping plunger at the full delivery or injection rate, a part stroke or leakage path over which a portion of the fuel flows off through the second relief line, the fuel injection rate thus being reduced. Finally a residual stroke of the pumping plunger occurs at the full delivery rate. For effective quiet running, especially in the low-load range, as low a delivery rate or as long an injection duration as possible is desired. This can be accomplished with a long leakage path. However, increasing this leakage while meeting the requirement that in full-load operation the full delivery rate be assured is feasible in the prior-art pump only within narrow limits. One factor to be considered here is that the effective stroke of the pumping plunger cannot be increased at will, especially in distributor-type injection pumps, without creating other problems. Also, it should be borne in mind that for precise metering a considerable portion of the stroke of the pumping plunger is required for compression of the volume of fuel between the plunger and the point of fuel injection, and that the control edge, disposed on a cylindrical slide valve, for example, must be capable of regulating the fuel quantity up to full-load operation with the requisite precision and accuracy.

The invention design according to a form of the invention, on the other hand, permits the leakage path to be made considerably longer, within the effective delivery stroke of the pumping plunger, than in the prior-art pump, especially also for the low-load range. Since the displaceable control edge then no longer controls the end of delivery but only controls the beginning of "leakage", it continues to serve advantageously for the metering of the fuel in the part-load range with decreasing duration of leakage and increasing load, and with complete cutoff of leakage in full-load operation.

The leakage path thus is considerably lengthened by comparison with the prior-art pump since the residual stroke at full delivery rate encountered in the prior-art pump is dispensed with.

Through the design according to a form of the invention it is possible to advantageously modify the distance sü by which the plunger would have to be advanced in order to open in the full-load setting the outlet D of the first relief line by means of the displaceable control edge. At the same time, the pre-set part stroke $h_x$, which corresponds to the distance sü, can be made to affect the length of the leakage path and the duration of injection, especially in the part-load range, depending on the design.

A modified embodiment of the invention characterizes a fuel injection pump which operates on the principle of beginning-of-delivery control but in other respects makes use of the same inventive features and principles as the fuel injection pump which operates on the principle of end-of-delivery control. This also has its advantages.

Through a modified embodiment of the invention, a minimal pressurizing stroke can be advantageously obtained whereby the volume between the working space of the pump and the injection port is brought to the opening pressure of the fuel injection valve.

A modified embodiment of the invention also makes it possible to advantageously obtain a pre-stroke with which the dead volume between the working space of the pump and the point of injection can be pressurized. This pre-stroke acts as a constant pre-stroke sv through the load range.

A modified embodiment of the invention permits the advantageous adjustment of the quantity of fuel injected at full load. In addition to adjustment in the positive or negative sense, boost-pressure-dependent adjustment of the fuel quantity injected at full load is obtained in the case of a supercharged internal combustion engine, depending on the means used to position the slide valve. As positioning means, known elements of the mechanical, electromechanical, pneumatic or hydraulic type may be employed to advantage.

In accordance with the invention, a fuel injection pump for an internal combustion engine comprises a barrel and a pumping plunger that is driven to reciprocate in the barrel and encloses in the barrel a pump working space which during a delivery stroke of the pumping plunger is communicable with a fuel injection point on the internal combustion engine. The pumping plunger includes a first relief line which permanently communicates with the pump working space and which has an outlet port which is opened and closed at an adjustable point in the course of the delivery stroke of the pumping plunger. The pump also includes control means adapted to be guided by a governor as a function of at least one of engine load and speed including a control edge for opening and closing the outlet port at the adjustable point. The pump also includes a relief channel branching off from the barrel. The pumping plunger includes a relief opening which permanently communicates with the pump working space and which upon completion of a pre-set maximum delivery stroke of the pumping plunger communicates with the relief channel branching off from the barrel. In full load operation the control edge is adapted to be brought into a position beyond the position of the outlet port of the pumping plunger during the delivery stroke thereof.

For a better understanding of the invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings.

Five embodiments of the invention, to be described in greater detail further on, are represented in the accompanying drawings, wherein.

DETAILED DESCRIPTION OF THE PREFERRED EMBODIMENTS

Figure 1:
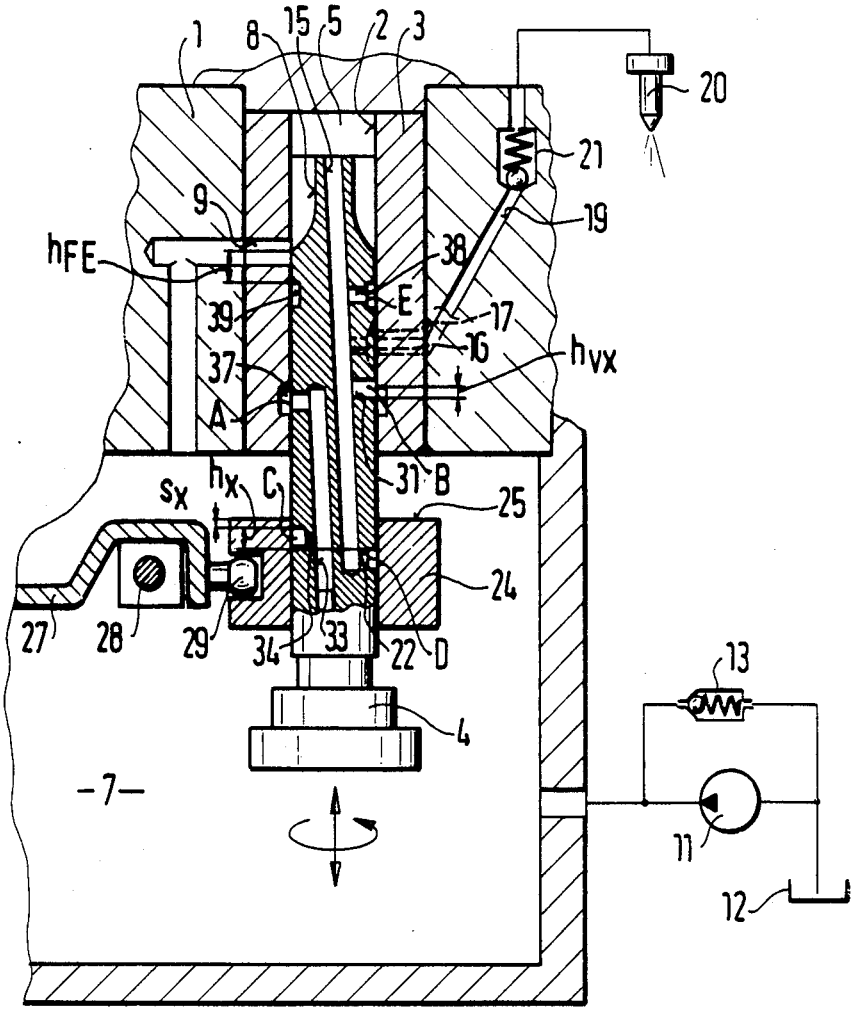
FIG. 1 is a sectional view, partly diagrammatic, of a first embodiment of a fuel injection pump operating on the fuel-quantity control principle of end-of-delivery control.

Referring now to FIG. 1, in a housing 1 of a fuel injection pump there is disposed in a barrel 2 of a cylindrical sleeve 3 set into the pump housing a pumping plunger 4 which is set into reciprocating and at the same time rotating motion by means which are not shown. The plunger encloses at one of its end faces a working space 5 and at its other end partly projects from the barrel 2 into a pump suction chamber 7. At that end, the plunger is driven as indicated by arrows.

The working space 5 of the pump is supplied with fuel, through longitudinal slots 8 in the outer surface of the pumping plunger and a suction bore 9 extending in the housing 1, while the plunger is executing its suction stroke or while it is in its lower dead-center position. At its other end, the suction bore opens into the suction chamber 7. The latter is supplied with fuel from a fuel tank 12 by means of a feed pump 11. The pressure in the suction chamber is controlled conventionally, and more particularly on the basis of engine speed, by means of a pressure-control valve 13, and the pressure can therefore also be used for control purposes.

A longitudinal channel 15 in the form of a blind hole, which hereinafter will be referred to as the first relief line 15, extends from the working space 5 in the pumping plunger. A radial bore 16 leading to a distributor opening 17 in the outer surface of the plunger 4 branches off from line 15. Within the range of that distributor opening, delivery lines 19 branching off in a radial plane from the barrel 2 are distributed over the circumference of the barrel in a number corresponding to that of the cylinders of the associated internal combustion engine to be fueled. The pumping plunger executes delivery strokes and suction strokes according to that number per revolution. The delivery lines 19 lead by way of a valve 21, conventionally formed by a check valve or a pressure relief valve, to the fuel injection nozzles 20.

At the end of the first relief line 15, a second radial bore 22 branches off which terminates in an outlet D in the outer surface of the pumping plunger, and more particularly in proximity to the portion of the plunger which projects into the suction chamber 7 of the pump.

In that area, a fuel-quantity regulating element in the form of a cylindrical slide valve 24 is mounted on the pumping plunger for tight displacement thereon and by its upper end face forms a control edge 25 whereby the outlet port D is controlled. The axial position of the cylindrical slide valve is determined conventionally by means of a control lever 27 that is pivotable on a pin 28 fixed to the housing and through a ball head 29 at the end of its arm is coupled to the cylindrical slide valve. Through a governor, which is not shown, the cylindrical slide valve is positioned as a function of load and/or speed. When large-quantity fuel injection is desired, the cylindrical slide valve 24 occupies, in the embodiment of FIG. 1, an upper position close to the working space of the pump, from which it is increasingly shifted downward as the load decreases. The effective stroke available at a given time which the plunger or the outlet port D must execute from lower dead center for port D to be opened thus varies, to the extent that port D is effective in control.

A third radial bore 31 branches off from the first relief line 15 and opens into a second outlet port B at the outer surface of the pumping plunger, and more particularly in an area that is surrounded by the barrel 2. In the pumping plunger 4 there is further provided a second relief line 33 which in the area of the plunger circumference that is constantly within the barrel 2 has an inlet port A and within the working range of the cylindrical slide valve 24 an outlet port C. The latter is spaced by a constant amount $h_x$ from the first outlet port D of the first relief line 15 in the direction of the working space of the pump so that in the course of the plunger stroke the control edge 25 always opens the outlet port C of the second relief line before it uncovers the first outlet port D of the first relief line 15. This is the case when the boundary edge of the end face of the cylindrical slide valve 24 is constructed as a control edge 25. However, the spacing $h_x$ can also be realized by means of staggered control edges when the outlet ports C and D open in the same radial plane. On the other hand, instead of locating the control edge 25 on the end face of the cylindrical slide valve, the control edge may be formed by the boundary edge of an internal annular slot in the cylindrical slide valve 24 which is connected with the suction chamber through one or more radial bores in the cylindrical slide valve. In another possible variant, the outlet ports C and D open into separate annular slots which communicate with one or more radial bores in the cylindrical slide valve which likewise lead to the suction chamber 7.

An internal annular slot 37 is formed in the wall of the barrel 2 in the stroke area of the inlet port A of the second relief line 33 and of the second outlet port B of the first relief line 15. The inlet port A and the second outlet port B are located so in relation to each other that the inlet port A of the second relief line constantly communicates with the annular slot 37 during the delivery stroke of the pumping plunger while the outlet port B of the first line 15 after a delivery stroke of the pumping plunger from its lowermost dead-center position passes out of registration with the annular slot 37 by the amount $h_{vx}$. This relationship may also be the reverse, as an equivalent. Moreover, the port B may also be connected with the working space of the pump through a line other than the relief line 15, for example, a line extending within the housing of the pump, as in the prior art cited at the outset. The inlet port A of the second relief line then should open into the annular slot 37 formed in the pumping plunger.

From the first relief line 15, a fourth radial bore 38 branches off and opens into an annular slot 39 in the outer surface of the pumping plunger in proximity to the barrel 2. Slot 39 serves as a relief opening E for the working space of the pump through which it communicates directly with the first relief line 15. The relief opening E can be connected with the suction bore 9, which leads away from the barrel 2 and serves as a relief channel, after the pumping plunger has executed a stroke of length $h_{FE}$ from the beginning of its delivery stroke. From that portion of the plunger stroke onward, all of the fuel displaced by the pumping plunger is returned to the suction chamber 7 through the relief channel 9.

During the operation of the fuel injection pump, the plunger first executes a suction stroke during which fuel passes into the working space 5 of the pump through the suction line 9 and at least one of the longitudinal slots 8, which may also be interconnected. At the beginning of the delivery stroke of the plunger which then follows, the working space 5 is completely filled with fuel that is at the low pressure prevailing in the suction chamber 7. The first pumping motion of the plunger then serves to raise the fuel in the working space to a pressure corresponding to the fuel injection pressure, this pressure then being transmitted through the first relief line 15, the first radial bore 16 and one of the delivery lines 19 with which the working space then is connected through the distributor port 17. For this pressurization of the volume of fuel, a stroke $h_v$ (FIG. 3) of the pumping plunger is required. Following this stroke, the further amount of fuel delivered by the plunger to the injection valve 20 is injected until either the outlet port D of the first relief line 15 is opened by the control edge 25 or the relief opening E is in registry with the suction bore 9. Here the special design illustrated in FIG. 1 comprising a second relief channel and its outlet and inlet ports, and the second radial bore 31 branching off from the first relief channel, can be disregarded for the time being. The fuel injection pump then operates as a fuel injection pump without a quiet-idle device. With the cylindrical slide valve 24 set at full load, the relief opening E in this design of fuel injection pump passes into registry with the suction bore 9 after a stroke of length $h_{FE}$ without the outlet port D of the first relief line being first opened.

Figure 2:
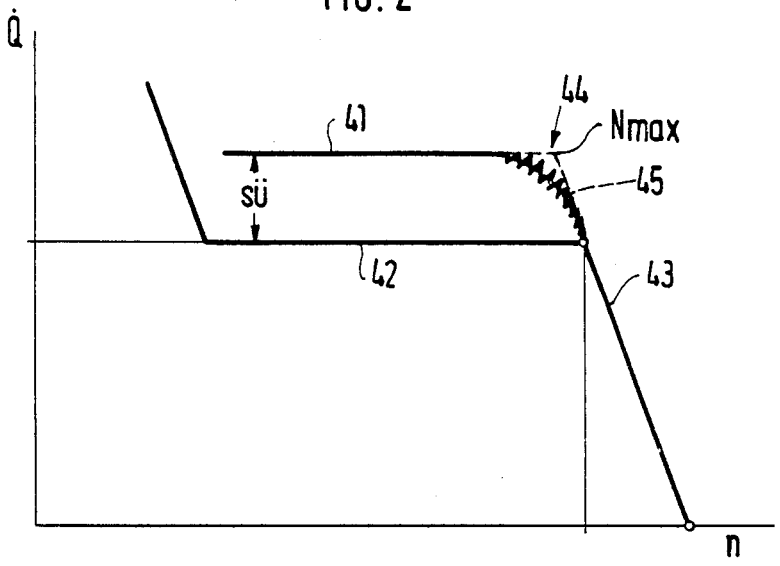
FIG. 2 is a load vs. speed diagram relating to the operation of the embodiment of FIG. 1.

The operation of this design will now be desribed with reference to the diagram of FIG. 2. In the latter, characteristic curves Q are plotted against engine speed n, these being a full-load curve 41, as obtained with a prior-art distributor injection pump without a relief opening E, and a full-load curve 42 according to the present design of fuel injection pump incorporating a relief opening E. In the prior-art pump, the full-load curve 41 exhibits instabilities 44 in the form of oscillations resulting in a rounding 45 or blurring in proximity to the breakaway slope 43. The point of maximum power $N_{max}$ resulting from the extension of the full-load curve 41 and the extension of the slope 43 cannot be attained in the prior-art pump because of the action of the governor, described earlier. Through the design of the invention as illustrated in FIG. 1, which incorporates a relief opening E, a full-load curve 42 is now obtained which extends a sufficient distance sü below the full-load curve 41. With the fuel injection pump designed accordingly, the necessary fuel-quantity injection at $N_{max}$ can still be provided for. Yet the transient response to the control measure at the slide valve 24 will then have no effect on fuel metering at that operating point. In the full-load position, the cylindrical slide valve 24 exhibits a sizable area in registration due to the distance along the stroke between full-load curve 41 and full-load curve 42. In this way, the associated internal combustion engine can be run neatly up to maximum load at top speed without loss of rated power.

Figure 3:
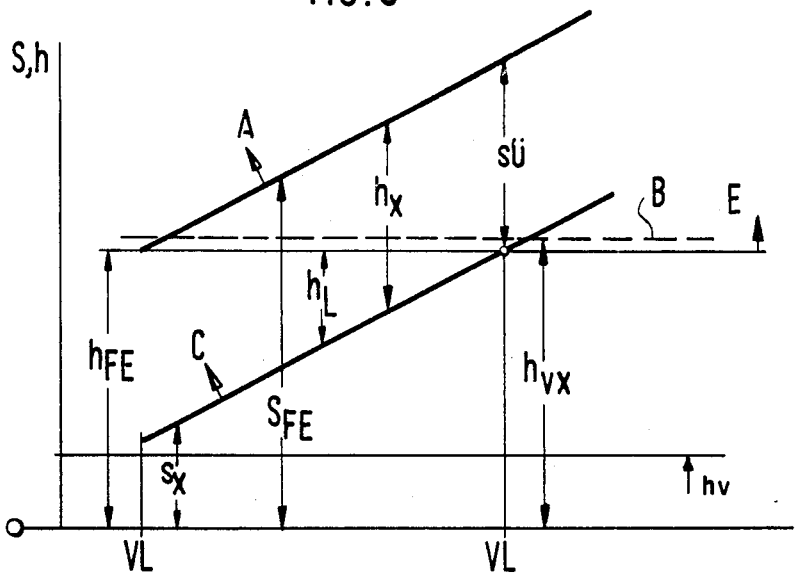
FIG. 3 is a control diagram plotting slide-valve or plunger stroke against load for the embodiment of FIG. 1.
Figure 3A:
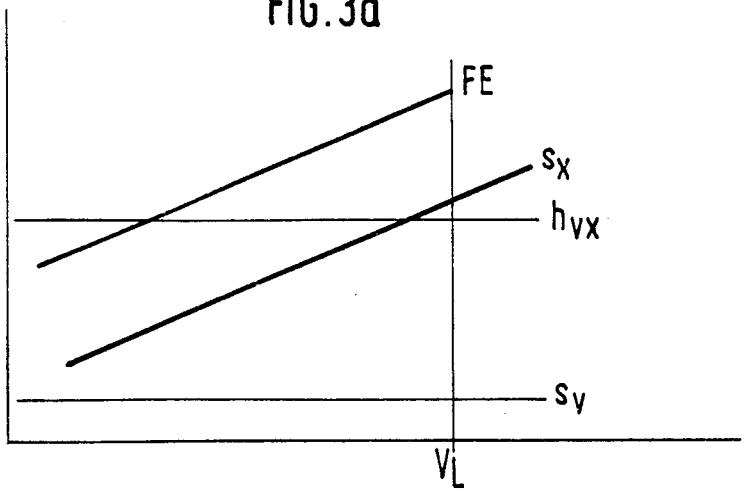
FIG. 3*a* plots the injection-rate distribution for a prior-art fuel injection pump incorporating provision for quiet idling.

The same advantageous behavior can now be obtained with a fuel injection pump incorporating a quiet-idle provision according to FIG. 1. In combination with the relief opening E, which now determines the end of delivery at full load, further advantages accrue in that the leakage path that affects quiet running can be made longer than in prior-art fuel injection pumps. FIG. 3 is a diagram in which the stroke of the pumping plunger and the path of the cylindrical slide valve 24 with the control edges are plotted against load at various load points. To begin with, there is the horizontal coaxial line $h_v$, plotted from the beginning of the plunger stroke, which characterizes the stroke for the pressurization of the fuel in the working space of the pump and in the delivery line which follows it, as mentioned earlier. Then there is the line E extending parallel to the abscissa, which characterizes the stroke $h_{FE}$ after which the working space of the pump is connected with the suction chamber 7 through the relief opening E. That line thus represents the absolute end of delivery FE. As a diagonal corresponding to the displacement of the slide valve between no load LL and full load VL, there is plotted a curve C which represents the position of the outlet port C relative to the control edge 25 on the slide valve 24. The stroke of the plunger up to the opening of the outlet port C corresponds to the length of the slide-valve displacement $s_x$, which increases as the load increases or as the slide valve 24 moves closer to the upper dead-center position of the pumping plunger. From line C on, the second relief channel 33 communicates with the suction chamber 7, and at the same time there is a connection through the annular slot 37 with the outlet port B or with the first relief line 15, respectively. Over that path, fuel is able to flow during the stroke $h_{vx}$ from the working space of the pump into its suction chamber 7. The amount of fuel which thus flows off in the bypass can be regulated by means of a throttle 34 inserted ahead of the outlet port C. After the latter has been opened, the plunger pumps fuel both at a throttled rate into the suction chamber 7 and under high pressure into the delivery line 19 cut in at the moment until the working space of the pump is completely vented through the connection between relief opening E and suction bore 9 so that high pressure cannot any longer build up in the working space of the pump and fuel injection ends. Depending on the design of the fuel injection pump, for example, whether an outlet port D is provided, and depending on the spacing of the opening point of outlet port D from outlet port C, the pump delivery in the low-load range may also be terminated prematurely, before the relief opening E is connected with the suction bore 9. With increasing slide-valve displacement toward the working space of the pump, the advancement of this relief point is reduced until the relief opening alone is effective as an element controlling the end of delivery. The farther the cylindrical slide valve 24 is shifted upward, the shorter the effective leakage path between the opening point of outlet port C and the end of delivery FE, and the greater the proportion of leakless fuel delivery. The range of displacement of the cylindrical slide valve is correlated in such a way that in full-load operation the leakage path $h_L$ becomes zero. The alignment $h_{vx}$ of the outlet port B with the annular slot 37 is then designed so that it corresponds to the stroke $h_{FE}$ or is of somewhat greater length. Only while port B is in registration with the annular slot 37 is fuel able to leak through the bypass to the suction chamber 7. If $h_{vx}$ is shorter than $h_{FE}$, this leakage is terminated prematurely and the full-load quantity of fuel established by the stroke $h_{FE}$ is injected too early. In other words, the leakage range is then limited. If $h_{vx}$ is of slightly greater length than $h_{FE}$, the quantity of fuel injected at full load is determined by the relief opening E alone, the full-load point then being located at the intersection of the control curves C and E. To open the outlet port D, a further stroke sü corresponding to the area in registration would then be required. The outlet port D of the second relief line may be dispensed with if desired.

With the present design, the part-load range thus is controlled by means of the slide-valve displacement and of the distribution so effected of the proportions of full fuel delivery and fuel delivery with some leakage. All that is necessary at the full-load operating point is that the outlet port C be securely closed so that here the fuel displaced by the pumping plunger is injected at the original fuel delivery rate. In this way, a relatively large leakage-path proportion is obtained particularly in the low-load range, which can be made much larger than in prior-art pumps. For comparison, FIG. *3a* gives the injection-rate distribution obtained with a fuel injection pump lacking the relief opening E.

Figure 4:
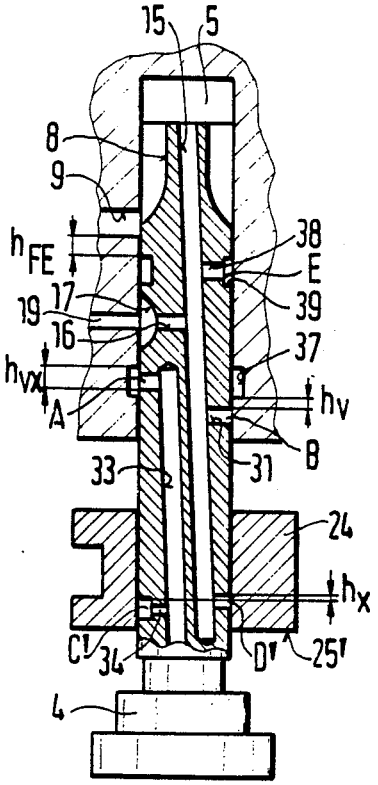
FIG. 4 is a sectional view, partly diagrammatic, of a second embodiment in the form of a distributor fuel injection pump operating on the principle of beginning-of-delivery control.

The second embodiment shown in FIG. 4 is a distributor fuel injection pump of basically the same design as the embodiment of FIG. 1, except that in this case the actuation of the cylindrical slide valve by the governor is the reverse of what it is in the embodiment of FIG. 1 and that the fuel injection pump operates on the principle of beginning-of-delivery control. Identical parts here are assigned the same reference numerals; and with regard to their description, reference is made to the previous embodiment. In contrast to the embodiment shown in FIG. 1, the outlet port C′ of the second relief line 33 here is closer to the lower dead-center position of the pumping plunger 4 than the outlet port D′ of the first relief line 15. The spacing along the stroke between the two outlet ports is $h_x$, as in the preceding embodiment. In the present embodiment, the boundary edge of the end face 25′ directed toward the lower dead-center position of the pumping plunger serves as control edge 25′. In the embodiment shown in FIG. 4, the cylindrical slide valve 24 is in its lowermost position, which corresponds to the maximum fuel-injection quantity. When the cylindrical slide valve is pictured as displaced far enough toward the upper dead-center position of the pumping plunger, then, with the outlet ports C′ and D′ initially open, the outlet port D′ is closed first by the control edge 25′ during a plunger movement, and after a further stroke $h_x$ the outlet port C′ is closed.

Moreover, the outlet port B of the first relief line 15 is located so that it comes into registration with the annular slot 37 only after a stroke $h_v$. At that instant, the inlet port A of the second relief line 33 is still in registration with the annular slot 37. The total stroke which the pumping plunger is able to execute until the inlet port A of the second relief line 33 is closed is the stroke $h_{vx}$, which corresponds to the stroke $h_{vx}$ in the embodiment of FIG. 1. The stroke $h_{vx}$ is of greater length than the stroke $h_v$.

As in the embodiment of FIG. 1, provision is made also in the embodiment shown in FIG. 4 for a stroke $h_{FE}$, following which the outlet E in the form of the annular slot 39 comes into registration with the suction bore 9. Here, too, the stroke $h_{FE}$ is shorter or at least not longer than the stroke $h_{vx}$.

Figure 5:
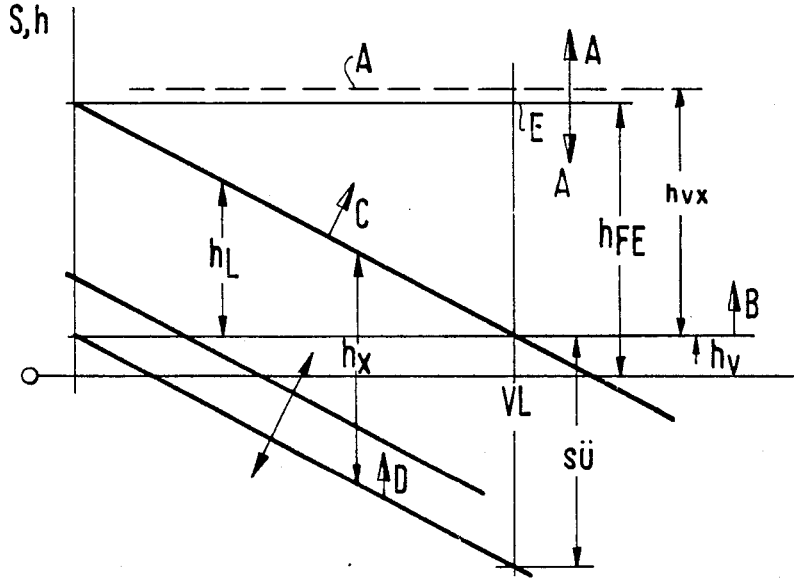
FIG. 5 is a control diagram plotting slide-valve or plunger stroke against load for the embodiment of FIG. 4.

FIG. 5 gives the control diagram of this pump design, constructed like the diagram of FIG. 3. Plotted in FIG. 5 as a coaxial line B' is the stroke $h_v$, before which there can be no leakage. As in the preceding embodiment, this stroke serves to pressurize the volume of fuel in the working space of the pump and in the delivery line 19 which follows it. This stroke is followed from the lowest load range up to the full-load operating point VL by the leakage path $h_L$, since from that stroke on the working space 5 of the pump communicates through the annular slot 37 with the second relief line 33, whose outlet port C' is not closed as yet in those load ranges by the control edge 25' after the stroke $h_v$. After the stroke $h_L$, the line C' is reached, following which the outlet port C' is closed. The outlet port D' has then been closed in any case even before a stroke of length sü. Thus, after the line C', the full quantity of fuel delivered by the pumping plunger 4 per stroke unit is injected until the relief opening E to the suction bore 9 is opened. This is represented also in FIG. 5 by a coaxial line E. The stroke $h_{vx}$ now is of the same length or of greater length, which is indicated in FIG. 5 by the broken line A. The outlet port C' is closed not later than when the full-load point VL is reached, and the outlet port B' then registers with the annular slot 37. The pressurizing stroke $h_v$ then is followed directly by the effective delivery stroke of the pumping plunger at the full injection rate until the relief opening E is opened when the full-load fuel quantity has been reached. Here, too, the maximum length of the leakage path can be varied by varying the length of the stroke $h_x$ or the position of outlet port D' relative to outlet port C'. As in the first embodiment, at part load fuel is thus injected, after a pressurizing stroke of constant length, during the stroke $h_L$ at reduced injection rate. That rate can be further modified by appropriate sizing of the throttle 34. There then follows, with a swiftness that increases as the load level moves up to full load, an injection phase at the original high rate of injection. Here, too, a very prolonged phase at reduced injection rate is obtained particularly for the no-load and low-load ranges. With full-load operation, the leakage path $h_L$ then becomes zero, so that here maximum power output of the internal combustion engine is assured by appropriate fuel injection. The special effect of the relief opening E, described earlier, thus becomes apparent. As in the first embodiment, the use of the throttle 34 here results in a reduction of the amount of leakage per plunger stroke with increasing engine speed. At high speed, the amount of fuel which actually flows off through the bypass over the second relief line 33 becomes zero, with the position of the cylindrical slide valve then also corresponding roughly to the effective delivery stroke of the pumping plunger.

The design modification shown in FIG. 4, which involves the position of the outlet port B relative to the annular slot 37 and the initial stroke $h_v$ so realized, can be similarly employed in the embodiment of FIG. 1. If so employed, the stroke $h_{vx}$ would be defined on the side where the inlet port A of the second relief line 33 is located in the embodiment of FIG. 1, while the outlet port B of the third radial bore 31 would be shifted toward the lower dead-center position of the pumping plunger, so that the outlet port B would line up with the annular slot 37 only after an initial stroke $h_v$ of the pumping plunger. In this way, a dependable initial stroke of precisely defined, constant length can be maintained over the entire operating range of the fuel injection pump. For enlargement of the controlled cross-sectional areas, the outlet ports C, D and B, or C' and D', respectively, and the inlet port A may, in principle, also take the form of annular slots to prevent throttling effects.

Figure 6:
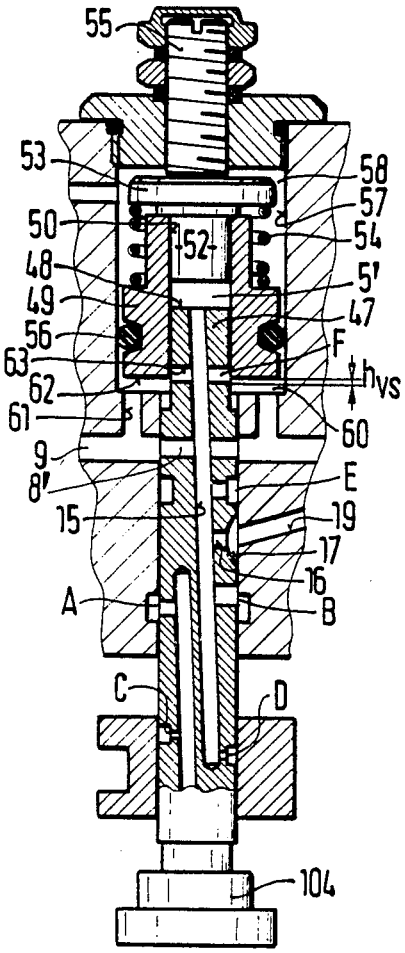
FIG. 6 is a sectional view, partly diagrammatic, of a third embodiment as a modification of the embodiment represented in FIG. 1 with control of the effective delivery stroke.

In a further modification of the embodiment of FIG. 1, a stepped plunger 104 is used, as shown in FIG. 6, which with respect to control of the outlets C, D, B and E and of the inlet A is constructed like the pumping plunger 4 of the embodiment illustrated in FIG. 1. In contrast to plunger 4, plunger 104 is provided at its upper end with a piston 47 of reduced diameter whose end face 48 encloses the working space 5' of the pump. This working space is formed in FIG. 6 by a slide valve 49 set onto the outer surface of the stepped-piston section 47 and provided with a through bore 50 in which the stepped-piston section 47 is tightly guided. From its other end, a sealing plug 52 penetrates into the through bore 50, the working space 5' being enclosed between that plug and the end face 48 of the pumping plunger 104. The plug 52 is attached to a spring cup 53 between which and the slide valve 49 a compression spring 54 is confined. The spring cup 53 abuts on a setscrew 55 which is coaxially threaded into the pump housing and can be adjusted to displace the plug 52 together with the slide valve 49 as soon as the latter comes to abut on the spring cup 53, with the compression spring 54 compressed.

The slide valve 49 in turn is displaceable in a cylindrical bore 57 that is coaxial with the pumping-plunger axis and separates by means of a sealing surface 56 a pressure-relieved space 58 within the bore 57 from a pressurized space 60. The latter is connected through bores 61 with the suction bore 9 and the suction chamber 7 and through that connection is constantly pressurized with the speed-dependent pressure prevailing in the suction chamber 7 of the pump. That pressure tends to displace the slide valve 49 against the force of the compression spring 54 and to displace a control edge formed by the end face 62 of the slide valve which is directed toward the pressurized space. Said control edge cooperates with an outlet F of a transverse bore 63 through the stepped-piston section 47, with the transverse bore intersecting the first relief channel 15. For the filling of the working space of the pump, radial bores 8' opening into the relief channel 15 are provided in place of the slot 8 in FIG. 4.

Figure 8:
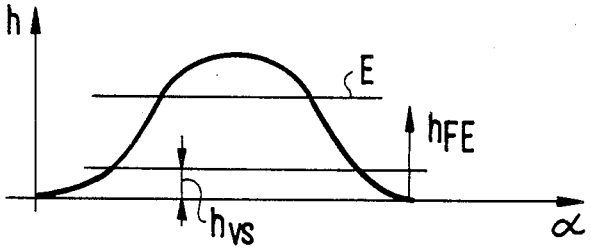
FIG. 8 is a diagram plotting the plunger stroke against the angle of rotation, correlated with the specific plunger strokes affecting control.

With this design, the provision of excess fuel for injection upon the starting of the internal combustion engine can be readily accomplished. Upon the starting of an internal combustion engine or in the middle of the starting cycle of a speed-actuated fuel injection pump, the fuel pressure prevailing in the suction chamber of the pump is very low at first so that the slide valve 49 is displaced toward the lower deadcenter position of the pumping plunger. In that position, with the pumping plunger 104 in its starting position, the outlet F of the third relief line formed by the transverse bore 63 is closed by the slide valve 49. As the engine speed increases, the pressure in the pressurized space 60 rises, which results in a displacement of the slide valve 49 until it comes to abut on the spring cup 53. In that position, the outlet F is at first open as the pumping plunger begins its stroke but is closed after a stroke $h_{vs}$. Delivery then proceeds as described in connection with the preceding embodiments. The stroke $h_{vs}$ can be varied by means of the setscrew 55. In FIG. 8, this stroke $h_{vs}$ is plotted as a coaxial line in an elevation diagram of the pumping plunger.

Figure 7:
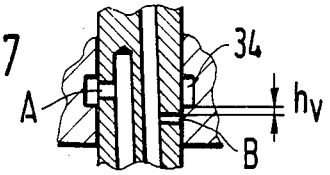
FIG. 7 is a sectional view, partly diagrammatic, of a modification of the embodiment represented in FIG. 6 with provision for a constant pressurized volume.

Shown in FIG. 7 is, moreover, a design modification which, independently of the starting-quantity prestroke $h_{vs}$, provides for normal operation of the fuel injection pump an initial stroke $h_v$ in which the outlet B is shifted to the lower dead-center position of the pumping plunger 104, in a manner similar to the embodiment shown in FIG. 4.

Instead of incorporating a stepped-piston section 47 in the pumping plunger 104 shown in FIG. 6, the plunger may be of uniform diameter throughout, which of course militates against compactness. In the embodiment of FIG. 6, the diameter of the portion of the pumping plunger which is effective in control may be advantageously enlarged, which will prove beneficial especially in the fueling of an internal combustion engine having a great many cylinders insofar as precision of control, spacing of and sealing between the controlled cross-sectional areas is concerned. Moreover, in place of the control edge formed on the end face 62, the slide valve 49 may be provided with a control port or annular slot that is connected with the pressurized space 60 or with the pressure-relieved space 58, just as the cross-sectional area F may be executed as an annular slot. These are equivalent design features.

Figure 9:
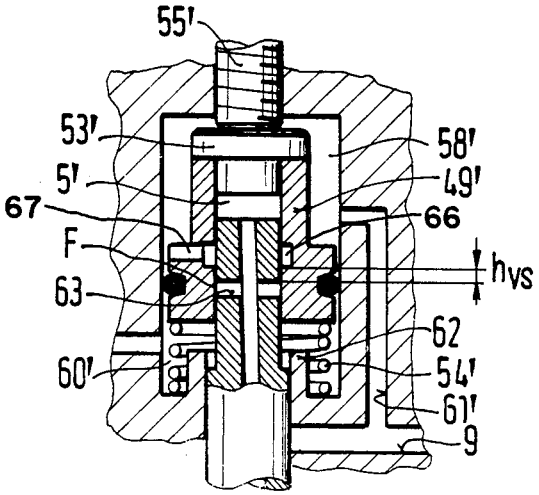
FIG. 9 is a sectional view, partly diagrammatic, of a fifth embodiment as a modification of the embodiment of FIG. 6.

To provide extra fuel for starting in distributor pumps operating on the principle of beginning-of-delivery control, provision for an additional pumping stroke $h_{vs}$ can also be made by introducing the suction-chamber-dependent pressure into the space 58' in FIG. 9, which corresponds to space 58 in FIG. 6 but here serves as a pressurized space. The enclosed space 60' on the other side of the slide valve 49', which in FIG. 6 is the pressurized space 60, is now vented toward the fuel tank 12 and accommodates the compression spring 54', which urges the slide valve 49 against the movable stop 53'. The latter is likewise displaceable, by means of the setscrew 55', but here does not serve as a spring cup. The other starting position of the slide valve 49' is formed, as in the embodiment of FIG. 6, by a collar 62 which surrounds the pumping plunger as it enters the space 60 or 60'.

The outlet F of the third relief line 63, which remains at all times in proximity to the through bore 50, stays closed over the entire delivery stroke of the pumping plunger so long as the slide valve 49' is in its starting position, as shown in FIG. 9. The pumping plunger then delivers a quantity of excess fuel for starting that is increased by the amount $h_{vs}$ of the delivery stroke of the pumping plunger. However, if as a result of the rising suction-chamber pressure in the pressurized space 58' the slide valve 49' moves to its stop 62, the outlet F comes into registration, from a residual delivery stroke of the pumping plunger onward, with an annular slot 66 which is provided in the inner surface of the through bore 50 and which through a radial bore 67 is connected either with the pressurized space 58' or with the pressurized space 60' so that the fuel pumped over a residual delivery stroke of the pumping plunger flows off at relief time and high-pressure delivery then ceases.

The slide valve 49 or 49' can further be used to achieve speed-dependent adjustment of the quantity of fuel injected at full load. In principle it is also possible to displace the slide valve by means other than the pressure in the suction chamber. For example, electromechanical positioning elements may be used for this purpose.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A fuel injection pump for an internal combustion engine comprising:

a barrel;

a pumping plunger that is driven to reciprocate in said barrel and encloses in said barrel a pump working space which during a delivery stroke of said pumping plunger is communicable with a fuel injection point on the internal engine;

said pump including a first relief line which permanently communicates with said pump working space and which has an outlet port which is opened and closed at an adjustable point in the course of the delivery stroke of said pumping plunger;

control means adapted to be guided by a governor as a function of at least one of engine load and speed including a control edge for opening and closing said outlet port at said adjustable point;

a relief channel branching off from said barrel;

said pumping plunger including a relief opening which permanently communicates with said pump working space and which upon completion of a pre-set maximum delivery stroke of said pumping plunger communicates with said relief channel branching off from said barrel; and in full-load operation said control edge being adapted to be brought into a position where said outlet port of said pumping plunger is opened during the delivery stroke thereof after said relief channel has been brought into communication with said relief opening.

2. A fuel injection pump according to claim 1, in which said relief opening comprises an annular slot in the outer surface of said pumping plunger and which includes a channel branching off from said first relief line and opening into said annular slot.

3. A fuel injection pump according to claim 2, in which said relief channel branching off from said barrel comprises a suction channel and which includes a fuel-supply pump communicating through said suction channel with said barrel and which includes control openings communicating during the suction stroke of the pumping plunger with said pump working space.

4. A fuel injection pump for an internal combustion engine comprising:

a barrel;

a pumping plunger that is driven to reciprocate in said barrel and encloses in said barrel a pump working space which during a delivery stroke of said pumping plunger is communicable with a fuel injection point on the internal engine;

a relief channel branching off from said barrel;

said pumping plunger including a relief opening which permanently communicates with said pump working space and which upon completion of a pre-set maximum delivery stroke of said pumping plunger communicates with said relief channel branching off from said barrel;

said pumping plunger includes a second relief line with an inlet port and an outlet, and a first relief line which permanently communicates with said pump working space and which has an outlet port communicating with said inlet port of said second relief line, the communication between said outlet port of said first relief line and said inlet port of said second relief line being broken from an initial pre-set delivery stroke from beginning of the stroke of said pumping plunger, and said outlet of said second relief line being opened by the motion of said pumping plunger at an adjustable point along the course of the delivery stroke of said pumping plunger by a control edge, adjusted by a governor as a function of at least one of load and speed, at a stroke given by the position of said control edge before the end of the pre-set delivery stroke or of the maximum delivery stroke of said pumping plunger when said control edge is set for part load, or at the end of said strokes when said control edge is set for full load, the pre-set maximum delivery stroke of said pumping plunger being of at least the same length as its initial pre-set stroke.

5. A fuel injection pump according to claim 4, in which said control edge controlling said outlet of said second relief line is in synchronism with a control edge controlling a further port, which is an outlet port, of a relief line communicating directly with said working space of the pump, the opening of said outlet of said second relief line occurring during the delivery stroke of said pumping plunger at a constant, pre-set part stroke ahead of the adjustable point at which said control edge controlling said further outlet port opens said further outlet port along the course of the delivery stroke of said pumping plunger.

6. A fuel injection pump for an internal combustion engine comprising:

a barrel;

a pumping plunger that is driven to reciprocate in said barrel and encloses in said barrel a pump working space which during a delivery stroke of said pumping plunger is communicable with a fuel injection point on the internal engine;

a relief channel branching off from said barrel;

said pumping plunger including a relief opening which permanently communicates with said pump working space and which upon completion of a pre-set maximum delivery stroke of said pumping plunger communicates with said relief channel branching off from said barrel;

said pumping plunger includes a second relief line with an inlet port and an outlet, and a first relief line which permanently communicates with said pump working space and which has an outlet port communicating with said inlet port of said second relief line, the communication between said outlet port of said first relief line and said inlet port of said second relief line being broken from an initial pre-set delivery stroke from beginning of the stroke of said pumping plunger, and said outlet of said second relief line being closed by the motion of said pumping plunger at an adjustable point along the course of the delivery stroke of said pumping plunger by a control edge, adjusted by a governor as a function of at least one of load and speed, at a stroke given by the position of said control edge before the end of the pre-set delivery stroke or of the maximum delivery stroke of said pumping plunger when said control edge is set for part load, the pre-set maximum delivery stroke of said pumping plunger being of at least the same length as its initial pre-set stroke.

7. A fuel injection pump according to claim 6, in which said control edge controlling said outlet of said second relief line is in synchronism with a control edge controlling a further port, which is an outlet port, of a relief line communicating directly with said working space of the pump, the closing of said outlet of said second relief line occurring during the delivery stroke of said pumping plunger at a constant, pre-set part stroke past the adjustable point at which said control edge controlling said further outlet port closes said further outlet port along the course of the delivery stroke of said pumping plunger.

8. A fuel injection pump according to claim 4 in which said inlet port of said second relief line communicates with said outlet port of said first relief line only after an initial part stroke after the beginning of the delivery stroke of said pumping plunger.

9. A fuel injection pump according to claim 7, in which said inlet port of said second relief line communicates with said outlet port of said first relief line only after an initial part stroke after the beginning of the delivery stroke of said pumping plunger, and in which said outlet of said second relief line is already closed, with said control edge which controls said outlet set for full load, before the initial part stroke is exceeded.

10. A fuel injection pump according to claim 4, in which with said control edge which controls said outlet of said second relief line set for minimum load, said outlet is opened only after an initial art stroke after the beginning of the delivery stroke of said pumping plunger, and in which said inlet port of said second relief line communicates with said outlet port of said first relief line at the beginning of the delivery stroke of said pumping plunger.

11. A fuel injection pump according to claim 4, which includes a throttle and in which the flow of fuel through the outlet of said second relief line is restricted by said throttle.

12. A fuel injection pump according to claim 6, which includes a throttle and in which the flow of fuel through the outlet of said second relief line is restricted by said throttle.

13. A fuel injection pump according to claim 1, which includes a third relief line communicating with said working space of the pump, said third relief line having an outlet which is located on said pumping plunger, and the pump including a slide valve that is axially positionable on said pumping plunger, said outlet of said third relief line being opened and closed in the course of the motion of said pumping plunger by said slide valve, the maximum length of the effective delivery stroke of said pumping plunger thus being variable.

14. A fuel injection pump according to claim 4, which includes a third relief line communicating with said working space of the pump, said third relief line having an outlet which is located on said pumping plunger, and the pump including a slide valve that is axially positionable on said pumping plunger, said outlet of said third relief line being opened and closed in the course of the motion of said pumping plunger by said slide valve, the maximum length of the effective delivery stroke of said pumping plunger thus being variable.

15. A fuel injection pump according to claim 6, which includes a third relief line communicating with said working space of the pump, said third relief line having an outlet which is located on said pumping plunger, and the pump including a slide valve that is axially positionable on said pumping plunger, said outlet of said third relief line being opened and closed in the course of the motion of said pumping plunger by said slide valve, the maximum length of the effective delivery stroke of said pumping plunger thus being variable.

16. A fuel injection pump according to claim 13, in which said slide valve is displaceable as a function of operating parameters.

17. A fuel injection pump according to claim 16, in which said outlet of said third relief line can be closed by means of said slide valve at an earlier or later point from the beginning of the delivery stroke of said pumping plunger.

18. A fuel injection pump according to claim 17, which includes a movable stop and a return spring and in which said slide valve is displaceable up to said movable stop by means of speed-dependent pressure against the force of said return spring.

19. A fuel injection pump according to claim 16, in which in the starting position at stopping speed of the fuel injection pump said slide valve maintains said outlet of said third relief line closed.

20. A fuel injection pump according to claim 16, in which said slide valve maintains said outlet of said third relief line closed until the end of the stroke of said pumping plunger.

21. A fuel injection pump according to claim 14, in which said slide valve is displaceable as a function of operating parameters.

22. A fuel injection pump according to claim 21, in which said outlet of said third relief line can be closed by means of said slide valve at an earlier or later point from the beginning of the delivery stroke of said pumping plunger.

23. A fuel injection pump according to claim 22, which includes a movable stop and a return spring and in which said slide valve is displaceable up to said movable stop by means of speed-dependent pressure against the force of said return spring.

24. A fuel injection pump according to claim 21, in which in the starting position at stopping speed of the fuel injection pump said slide valve maintains said outlet of said third relief line closed.

25. A fuel injection pump according to claim 21, in which said slide valve maintains said outlet of said third relief line closed until the end of the stroke of said pumping plunger.

* * * * *